US007808393B2

(12) United States Patent
Yokota

(10) Patent No.: US 7,808,393 B2
(45) Date of Patent: Oct. 5, 2010

(54) SMOKE DETECTOR AND SAMPLING AIR SUPPLYING METHOD FOR SMOKE DETECTOR

(75) Inventor: Hiroyuki Yokota, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 442 days.

(21) Appl. No.: 12/076,638

(22) Filed: Mar. 20, 2008

(65) Prior Publication Data

US 2009/0237259 A1 Sep. 24, 2009

(51) Int. Cl.
*G08B 17/10* (2006.01)

(52) U.S. Cl. ..... 340/628; 340/629; 340/693.6; 340/627; 73/863.33; 73/863.01; 73/863.02; 73/863.03; 356/37

(58) Field of Classification Search ..... 340/628, 340/627, 693.6; 73/863.33, 863.01, 863.03; 356/37

See application file for complete search history.

(56) References Cited

U.S. PATENT DOCUMENTS 5,103,212 A * 4/1992 Notarianni et al. ..... 340/628

* cited by examiner

*Primary Examiner*—Davetta W Goins
*Assistant Examiner*—Ojiako Nwugo
(74) *Attorney, Agent, or Firm*—Wenderoth, Lind & Ponack, L.L.P.

(57) ABSTRACT

In order to enable supply of a sampling air to a smoke detection portion at a stable flow velocity, the present invention provides a smoke detector including: a black box (21) including a smoke detection portion (25) having an inflow port and an outflow port; a sampling pipe (30) laid in a monitor space; a gas flow pipe (P) connected to the sampling pipe and which houses a fan (3) therein; a flow path branching portion (33) provided to the gas flow pipe on a secondary side of the fan and connected to the inflow port of the smoke detection portion; and a flow path merging portion (32) which is provided to the gas flow pipe on the secondary side of the fan and connected to the outflow port of the smoke detection portion, and at which a pressure of a fluid flowing through the gas flow pipe is lower than a fluid flowing through the gas flow pipe at the flow path branching portion.

4 Claims, 4 Drawing Sheets

SMOKE DETECTOR AND SAMPLING AIR SUPPLYING METHOD FOR SMOKE DETECTOR

BACKGROUND OF THE INVENTION

1. Field of the Invention

The present invention relates to a smoke detector for optically detecting contaminants such as smoke floating in the air, and a sampling air supplying method therefor.

2. Description of the Related Art

A smoke detector is used for preventing fire or as a detecting system at a time of occurrence of fire or in a semiconductor manufacturing plant or a food industry requiring a certain level of environmental conservation.

As the smoke detector, there is used a high-sensitive smoke detecting apparatus. In the high-sensitive smoke detecting apparatus, air is sucked from a warning area through a sampling pipe by driving a fan, light receiving signals are converted into pulse signals through a comparison between the light receiving signals and a threshold value using a comparator, the light receiving signals being obtained by irradiation of light whose beam spots are focused on smoke particles contained in the sucked air, and the number of the pulse signals are counted, thereby measuring a smoke amount (see Japanese Patent No. 3312712).

In a conventional example, a primary side (suction port side of fan) at which a fluid (sampling air) has not been applied with energy by a fan and a secondary side (exhaust port side) at which the fluid has been applied with energy are connected through a smoke detection portion of a black box, and by using a pressure difference between the primary side and the secondary side, the sampling air is supplied to the smoke detection portion.

Accordingly, depending on a state of a filter for filtration, which is provided to the fan or a pipe line, a sampling flow rate changes in some cases. When the sampling flow rate changes, due to P-Q characteristics of the fan, fluctuation is caused in the pressure difference between the primary side and the secondary side, and the sampling air cannot be supplied to the smoke detection portion at a preset flow velocity. Therefore, accurate smoke detection becomes difficult.

SUMMARY OF THE INVENTION

The present invention has been made in view of the above-mentioned circumstances, and it is an object of the present invention to enable supply of a sampling air to a smoke detection portion at a stable flow velocity.

The present invention relates to a smoke detector including: a smoke detection portion having an inflow port and an outflow port; a sampling pipe laid in a monitor space; a gas flow pipe which is connected to the sampling pipe and which houses a fan therein; a flow path branching portion provided to the gas flow pipe on a secondary side of the fan and connected to the inflow port of the smoke detection portion; and a flow path merging portion which is provided to the gas flow pipe on the secondary side of the fan and connected to the outflow port of the smoke detection portion, and at which a pressure of a fluid flowing through the gas flow pipe is lower than a fluid flowing through the gas flow pipe at the flow path branching portion.

The present invention relates to a smoke detector including: a smoke detection portion having an inflow port and an outflow port; a sampling pipe laid in a monitor space; a fan for connecting the sampling pipe to a suction port; a divergent pipe which has a substantially pyramidal shape connected to an exhaust port of the fan and which is wider downstream; a flow path branching portion provided downstream of the divergent pipe, for supplying a sampling air from the divergent pipe to the smoke detection portion; and a flow path merging portion provided upstream of the flow path branching portion, for performing exhaustion from the smoke detection portion to the divergent pipe.

The present invention relates to a smoke detector including: a smoke detection portion having an inflow port and an outflow port; a sampling pipe laid in a monitor space; a gas flow pipe which is connected to the sampling pipe and which houses a fan therein; a flow path branching portion provided to the gas flow pipe on a secondary side of the fan and connected to the inflow port of the smoke detection portion; and a flow path merging portion which is provided on the secondary side of the fan and in the vicinity thereof and connected to an outflow port of the smoke detection portion, and at which a pressure of a fluid flowing through the gas flow pipe is lower than a fluid flowing through the gas flow pipe at the flow path branching portion.

The present invention relates to a sampling air supplying method for a smoke detector, the smoke detector including: a smoke detection portion having an inflow port and an outflow port; a sampling pipe laid in a monitor space; a gas flow pipe which is connected to the sampling pipe and which houses a fan therein; a flow path branching portion provided to the gas flow pipe on a secondary side of the fan and connected to the inflow port of the smoke detection portion; and a flow path merging portion which is provided on the secondary side of the fan and in the vicinity thereof and connected to an outflow port of the smoke detection portion, and at which a pressure of a fluid flowing through the gas flow pipe is lower than a fluid flowing through the gas flow pipe at the flow path branching portion, the sampling air supplying method including introducing a part of the fluid from the flow path branching portion to the smoke detection portion owing to a pressure difference in the fluid on the secondary side of the fan.

The present invention is structured as described above. Accordingly, owing to the pressure difference in the fluid between the flow path branching portion and the flow path merging portion, a part of the sampling air flowing through the gas flow pipe is introduced from the flow path branching portion into the smoke detection portion, is allowed to pass through the smoke detection portion, and is returned into the gas flow pipe from the flow path merging portion. Therefore, the sampling air can be supplied to the smoke detection portion at a constant flow velocity, so accurate smoke detection can be performed.

DETAILED DESCRIPTION OF THE PREFERRED EMBODIMENTS

A first embodiment of the present invention will be described with reference to FIGS. 1 and 2.

Figure 1:
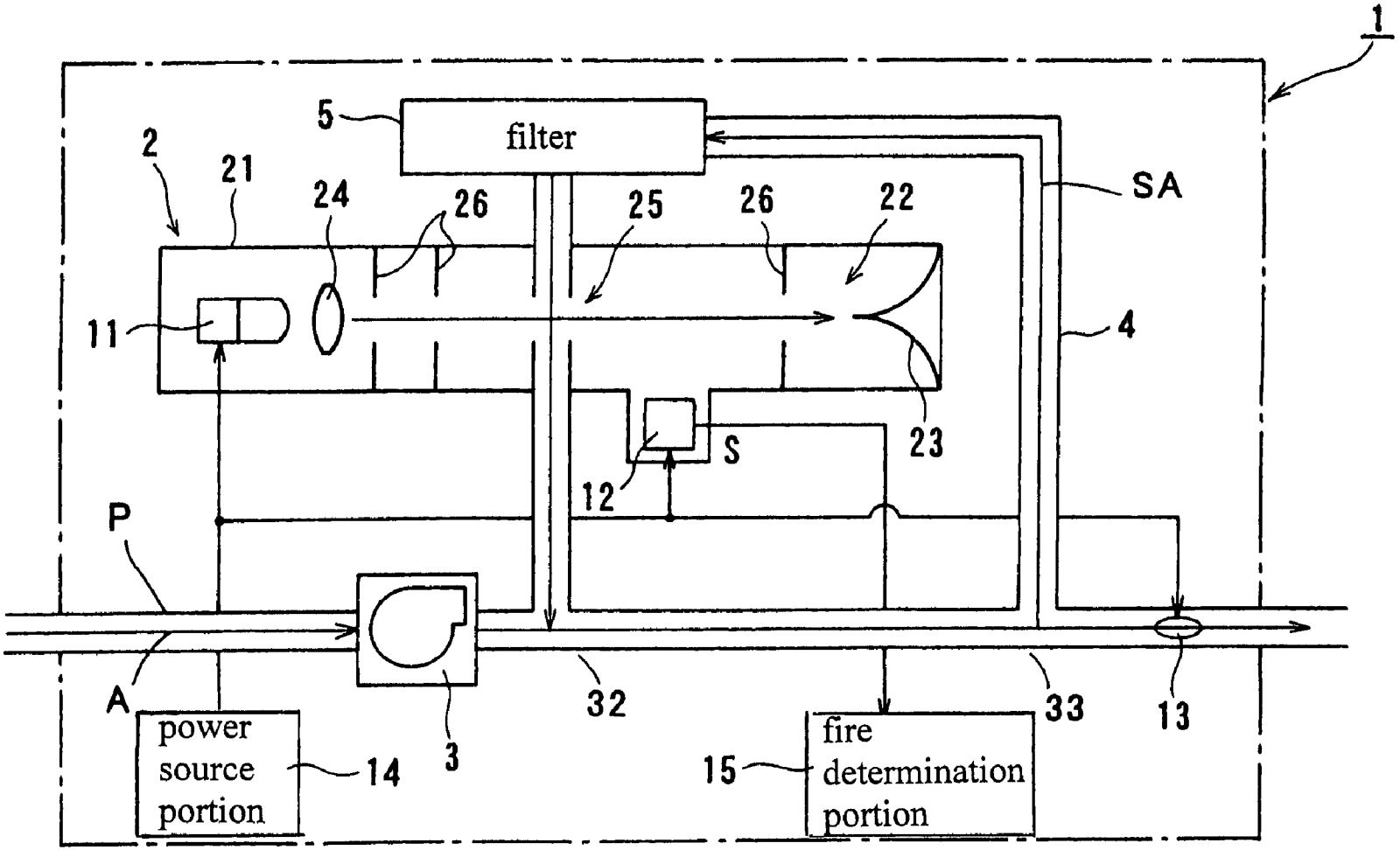
FIG. 1 is a structural view showing a first embodiment of the present invention.
Figure 2:
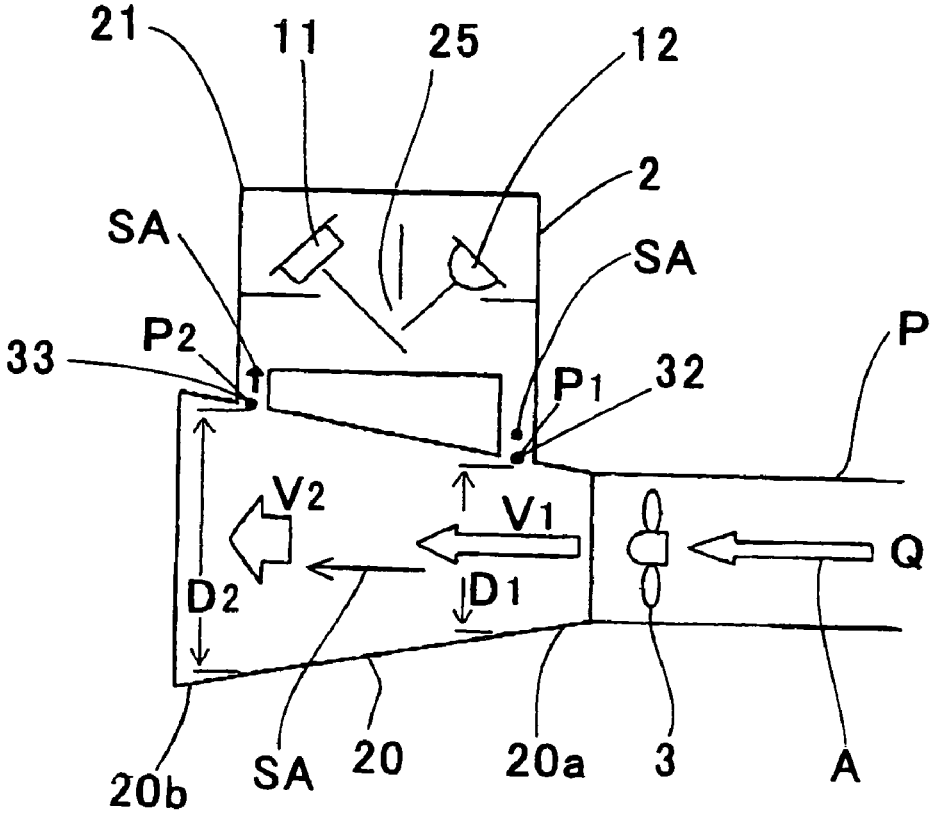
FIG. 2 is a vertical sectional view showing the first embodiment of the present invention.

As shown in FIG. 1, a smoke detector 1 includes a smoke detection unit 2 provided with a black box 21, a fan 3 for sending an air (sampling air) SA to be sensed by the smoke detection unit 2, a piping 4 constituting an air passage, a light emitting element 11 disposed in the smoke detection unit 2, a light receiving element 12 such as a photodiode, an air flow sensor 13 for measuring a flow rate of the fan 3 or air, a power source portion 14 for supplying power to the air flow sensor 13, and a fire determination portion 15 connected to a light receiving element 12.

Next, a description will be made of the smoke detection unit 2. In the black box 21 formed in a substantially cylindrical shape, there are provided the light emitting element 11 for emitting an infrared ray and a stray light portion 22 positioned in a position opposed to the light emitting element 11. Between those, there are provided a condenser lens 24 for condensing emitted light to a curved surface portion of a light trap 23 provided in the stray light portion 22, a smoke detection portion 25 through which allows air passes, the light receiving portion 12, and the like. Note that apertures 26 are provided at appropriate intervals so as to limit applied light. Into the smoke detection portion 25, the sampling air SA which has passed through the piping 4 and has been filtered by a filter 5 is introduced.

The light trap 23 according to the first embodiment of the present invention is formed in a substantially conical shape. Light L (not shown) entering the stray light portion is incident on the curved surface of the light trap 23 to be reflected a plurality of times. There is provided a structure by which, a reflection light amount is set such that the light L is attenuated in every reflection on the curved surface so as not to be diffused as diffused light to the smoke detection portion 25, in other words, to a field range of the light receiving element 12.

Note that the fire determination portion 15 includes an amplifier circuit for amplifying an output signal S of the light receiving element 12, an A/D converter for converting the amplifying circuit to a detection level, and a comparator circuit for determining fire when the detection level is equal to or higher than a threshold set in advance. A general control of the fire determination portion 15 is performed by a CPU.

In the following, a description will be made of a smoke detection operation according to the first embodiment of the present invention.

In a normal state, air sucked from a monitor space by the fan 3 flows from a top to a bottom of the smoke detection portion 25. When the air is clean, the light L is not scattered in the smoke detection portion 25, and the light L enter the inside of the stray light portion 22 while being condensed and in a state where a focal point is adjusted on the curved surface of the light trap 23.

On the light trap 23, a plurality of times of reflection are performed. The light L is attenuated in accordance with the number of times of the reflection. Accordingly, the stray light is not received by the light receiving element 12 and the output signal S is at a low level, so the determination on fire is not made.

At the time of occurrence of fire, smoke particles float in the sucked air. When the smoke particles are irradiated with the light L, the scattered light is generated in the smoke detection portion 25. The scattered light is received by the light receiving element 12. The output signal S corresponding to a received light amount is derived. The output signal S is supplied to the fire determination portion 15 and a processing of the signal is performed to notify the occurrence of fire by display or sound.

The light L which has passed through the smoke detection portion 25 is reflected as described above by the light trap 23, so the light L is attenuated, thereby not being received as the stray light. Accordingly, even at the time of occurrence of fire, the S/N ratio of the output signal is high, and the fire determination is correctly performed with high sensitivity and high accuracy.

On a secondary side of the fan 3 of a gas flow tube P, there is provided a diffuser portion 20. The diffuser portion 20 is wider downstream, for example, a divergent pipe (diffuser) having a substantially pyramidal shape such as a cone. A flow path merging portion 32 is provided to a side of a base end 20*a*. Further, a flow path branching portion 33 is provided to a side of a distal end 20*b* located downstream of the flow path merging portion 32.

For the fan 3, a centrifugal fan driven by a DC power source is selected, for example. A sampling pipe (not shown) for sucking the sampling air SA is connected to a suction port of the fan 3. An exhaust port of the fan is connected to the piping 4 through which the sampling air SA flows into the smoke detection unit 2.

Note that the fan may be an axial fan. Further, the fan may be driven by an AC power source.

A diameter D1 of the diffuser portion 20 at the flow path merging portion 32 is formed to be smaller than a diameter D2 thereof at the flow path branching portion 33. However, diameters of both the flow path merging portion 32 and the flow path branching portion 33 are the same. Sizes of the diameters D1 and D2, disposition positions of the flow path branching portion 33 and the flow path merging portion 32, and the like are appropriately selected. In the illustrated example, the divergent pipe has the conical shape but the divergent pipe may have a pyramidal shape.

On the secondary side of the fan 3, the black box 21 of the smoke detection unit 2 is provided. An inflow port of the smoke detection portion 25 of the black box 21 is connected to the flow path branching portion 33, and an outflow port of the smoke detection portion 25 is connected to the flow path merging portion 32. For a structure of the smoke detection unit 2, for the sake of description, components different from those of FIG. 1 are used, but a principle thereof is the same.

Next, an operation according to the first embodiment of the present invention will be described.

When the fan 3 is driven, air A in the monitor space is sucked into a gas flow pipe P through the sampling pipe (not shown) and passes through the diffuser portion 20 to be exhausted. However, in this case, a flow velocity at the flow path merging portion 32 in the diffuser portion 20 differs from a flow velocity at the flow path branching portion 33 therein, so a pressure difference is caused between those portions.

That is, according to Bernoulli's theorem: $V^2/2\ g+Z+p/r=\text{const.}$ (V: velocity, Z: height, p: pressure, γ: specific weight, and g: gravitational acceleration), when the inner diameter is larger than that of flow velocity $V=4\ Q\ (\text{flow rate})/D^2\pi$, the flow velocity is reduced. Accordingly, a relationship of a flow velocity V1 at the flow path merging portion 32>a flow velocity V2 at the flow path branching portion 33 is obtained. Therefore, a differential pressure Δp with respect to the smoke detection portion 25, that is, a pressure p2 of the flow path branching portion 33-*a* pressure p1 of the flow path merging portion 32 is derived by the following equation according to the Bernoulli's theorem.

$$(p2-p1)=\gamma\times(V1^2-V2^2)/2\,g$$

Owing to generation of the pressure difference, smoke particles existing in the sampling air SA flowing through the diffuser portion 20 are sucked from the flow path branching portion 33 and enter the inflow port of the smoke detection portion 25. The smoke particles advance in the smoke detection portion 25 while being irradiated with a laser beam of the light emitting element 11 to cause scattered light, and are returned to the diffuser portion 20 through the flow path merging portion 32.

The differential pressure Δp between the flow path merging portion 32 and the flow path branching portion 33 is always constant when a sampling flow rate is constant. Accordingly, the sampling air SA can be supplied to the smoke detection portion 25 at a constant flow velocity.

Figure 3:
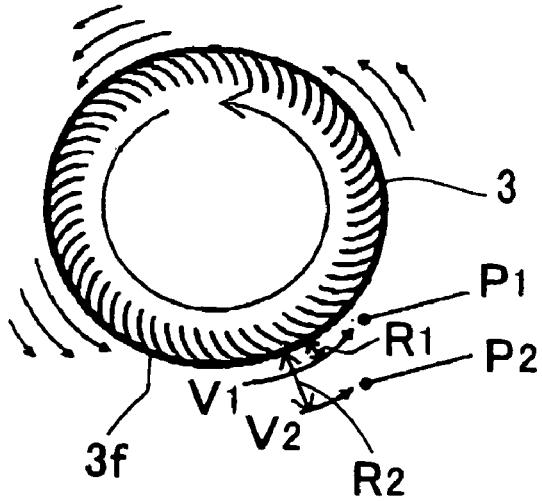
FIG. 3 is a front view showing a fan according to a second embodiment of the present invention.

A second embodiment of the present invention will be described with reference to FIGS. 3 and 4. Components denoted by the same reference symbols as those of FIGS. 1 and 2 have the same names and functions.

A difference between the second embodiment and the first embodiment is that, as differential pressure generation means, instead of the diffuser portion 20, the flow path branching portion and the flow path merging portion are provided in a position where the pressure difference is generated depending on distances from a periphery of a rotor 3*f* of the fan 3 on the secondary side of the fan 3.

Figure 4:
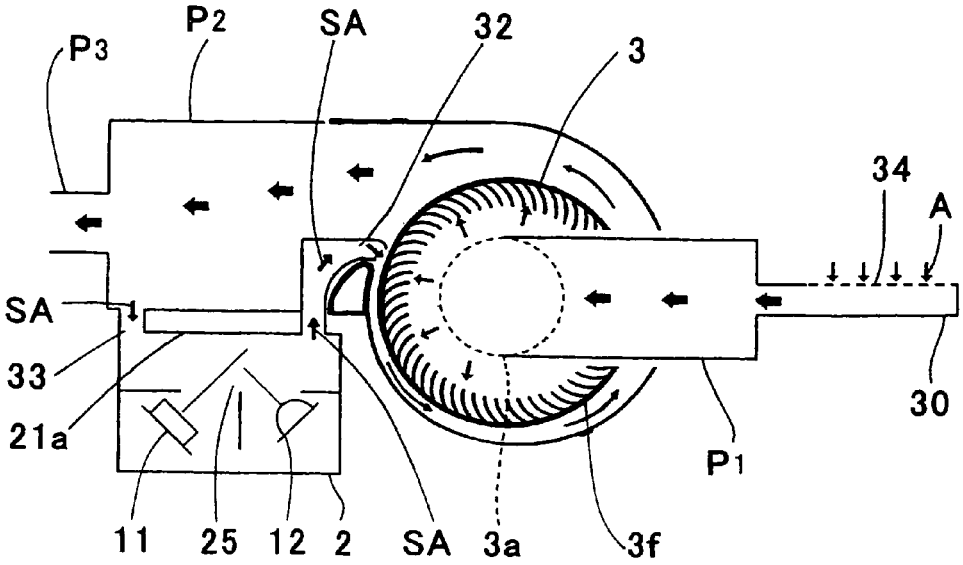
FIG. 4 is a vertical sectional view showing the second embodiment of the present invention.

That is, as shown in FIG. 4, a sampling pipe 30 provided in the monitoring area is connected to an intake port 3*a* of the fan 3 through a suction pipe (gas flow pipe) P1, an exhaust duct (gas flow pipe) P2 is provided to the secondary side of the fan 3, and a choke tube P3 is connected to a rear end of the exhaust duct P2. In the vicinity of the exhaust duct P2, the black box 21 is provided.

The outflow port of the smoke detection portion 25 of the black box 21 is connected to the flow path merging portion 32. However, the flow path merging portion 32 is provided at a position close to the periphery of the rotor 3*f* of the fan 3, for example, above a bottom surface 21*a* of the black box 21. The closer the position of the flow path merging portion 32 to the periphery of the rotor 3*f* of the fan 3 is, the faster the flow velocity becomes and the lower the fluid pressure becomes.

Further, the inflow port of the smoke detection portion 25 is connected to the flow path branching portion 33. However, the flow path branching portion 33 is provided on the rear end side of the exhaust duct P2, that is, downstream of the flow path merging portion 32 at an interval from the periphery of the rotor 3*f* of the fan 3. The farther the position of the flow path branching portion 33 from the periphery of the rotor 3*f* of the fan 3 is, the slower the flow velocity becomes and the higher the fluid pressure becomes. Accordingly, the differential pressure can be adjusted based on a positional relationship between the flow path branching portion 33 and the flow path merging portion 32.

In the second embodiment of the present invention, when the air A in the monitor space is sucked through a suction port 34 of the sampling pipe 30 by the rotation of the fan 3, the air A passes through the suction pipe P1 and flows into the exhaust duct P2.

In this case, a peripheral velocity V of the fan 3 is expressed by an equation $$V=\text{rpm}\ r\times\text{fan outer diameter}\ D\times\pi,$$

a flow velocity V1 at the flow path merging portion 32 spaced apart from the periphery of the rotor 3*f* of the fan 3 by a distance R1 is expressed by an equation $$V1=V$$

and a flow velocity V2 at a position (flow path branching portion 33) spaced apart from the rotor 3*f* of the fan 3 by a distance R2 is expressed by an equation $$V2=\text{coefficient of viscosity}\ \mu\times V1.$$

(coefficient of viscosity of air<1)

Accordingly, there is a flow velocity difference with a relationship of V1>V2. Therefore, the pressure difference is caused according to Bernoulli's theorem, and the sampling air SA is introduced into the inflow port of the smoke detection portion 25 from the flow path branching portion 33. Smoke particles contained in the sampling air SA are irradiated with a light beam applied from the light emitting element 11 to generate the scattered light, and is discharged from the outflow port to the flow path merging portion 32.

In the second embodiment of the present invention, when the rpm of the fan 3 is constant, the flow velocity difference, that is, the pressure difference is also constant. Accordingly, the sampling air SA can be introduced into the smoke detection portion 25 at a constant velocity. Further, when the smoke detection portion 25 is provided in the vicinity of the fan 3, the device can be downsized as a whole.

Figure 5:
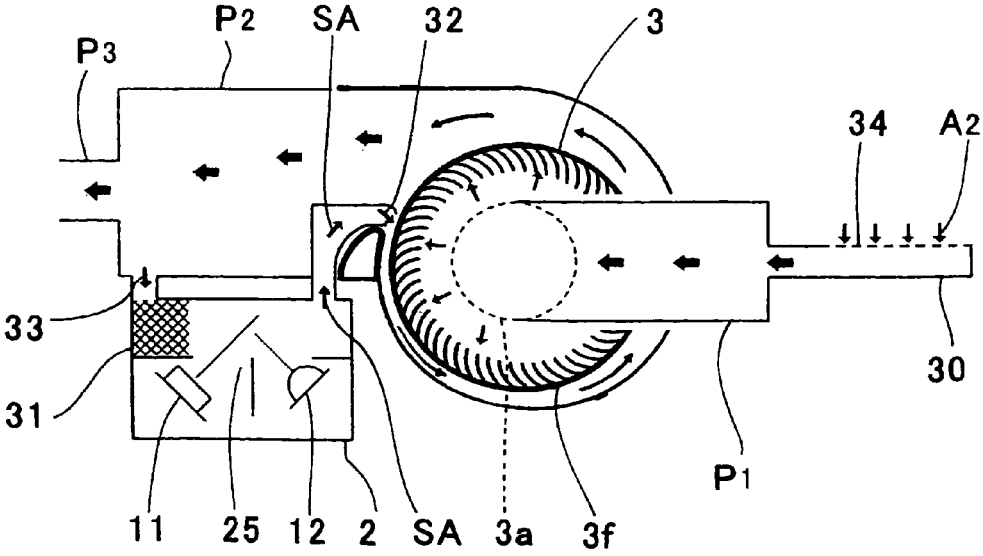
FIG. 5 is a vertical sectional view showing a third embodiment of the present invention.

A third embodiment of the present invention will be described with reference to FIG. 5. Components denoted by the same reference symbols as those of FIG. 4 have the same names and functions.

A difference between the third embodiment and the second embodiment of the present invention is that a filter 31 is provided to the flow path branching portion 33 to eliminate foreign substances such as waste in the sampling air SA. By the provision of the filter 31, the sampling air containing only smoke particles can be supplied to the smoke detection portion 25, so more accurate smoke detection can be performed.

Figure 6:
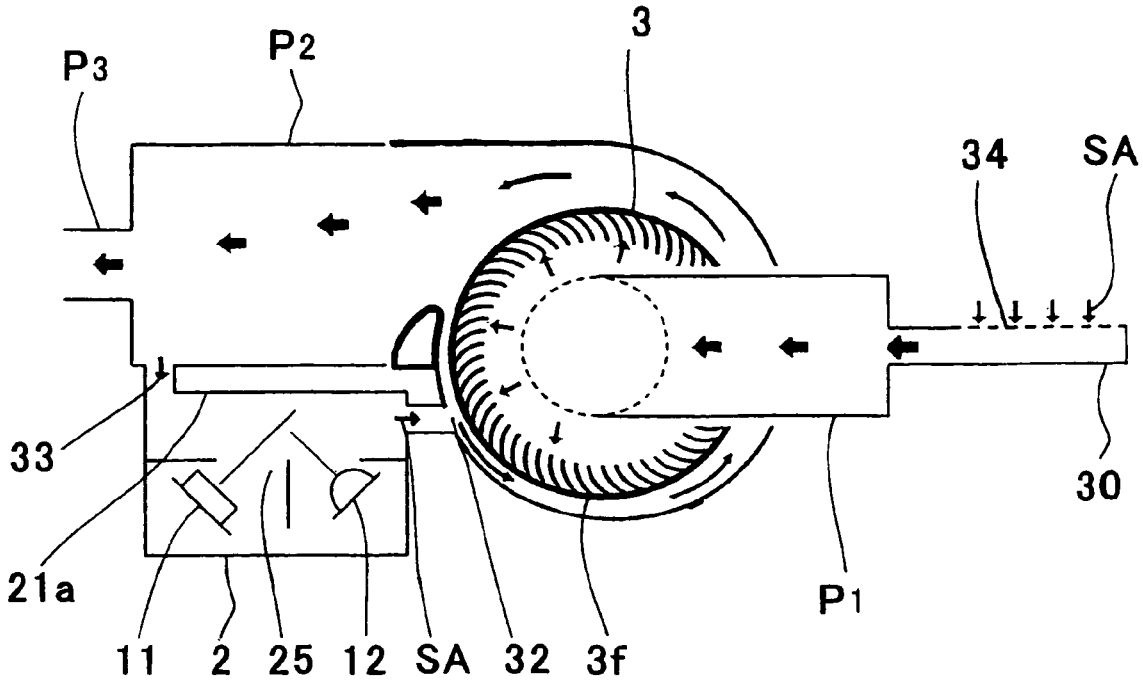
FIG. 6 is a vertical sectional view showing a fourth embodiment of the present invention.

A fourth embodiment of the present invention will be described with reference to FIG. 6. Components denoted by the same reference symbols as those of FIG. 4 have the same names and functions.

A difference between the fourth embodiment and the second embodiment (FIG. 4) of the present invention is that the flow path merging portion 32 is positioned below the bottom surface 21*a* of the black box 21, that is, the flow path merging portion 32 is provided downstream in the rotation direction of the fan 3.

The flow velocity in the peripheral portion of the rotor 3*f* of the fan 3 and in the vicinity thereof is constant in a position on the same periphery. Accordingly, the flow path merging portion 32 can be provided to any position on that periphery. In the fourth embodiment of the present invention, as compared to the second embodiment, the structure of the flow path in which the sampling air SA is introduced can be simplified.

What is claimed is:

1. A smoke detector, comprising:

a smoke detection portion having an inflow port and an outflow port;

a sampling pipe laid in a monitor space;

a gas flow pipe which is connected to the sampling pipe and which houses a fan therein;

a flow path branching portion provided to the gas flow pipe on a secondary side of the fan and connected to the inflow port of the smoke detection portion; and a flow path merging portion which is provided to the gas flow pipe on the secondary side of the fan and connected to the outflow port of the smoke detection portion, and at which a pressure of a fluid flowing through the gas flow pipe is lower than a fluid flowing through the gas flow pipe at the flow path branching portion.

2. A smoke detector, comprising:

a smoke detection portion having an inflow port and an outflow port;

a sampling pipe laid in a monitor space;

a fan for connecting the sampling pipe to a suction port;

a divergent pipe which has a substantially pyramidal shape connected to an exhaust port of the fan and which is wider downstream;

a flow path branching portion provided downstream of the divergent pipe, for supplying a sampling air from the divergent pipe to the smoke detection portion; and a flow path merging portion provided upstream of the flow path branching portion, for performing exhaustion from the smoke detection portion to the divergent pipe.

3. A smoke detector, comprising:

a smoke detection portion having an inflow port and an outflow port;

a sampling pipe laid in a monitor space;

a gas flow pipe which is connected to the sampling pipe and which houses a fan therein;

a flow path branching portion provided to the gas flow pipe on a secondary side of the fan and connected to the inflow port of the smoke detection portion; and a flow path merging portion which is provided on the secondary side of the fan and in the vicinity thereof and connected to an outflow port of the smoke detection portion, and at which a pressure of a fluid flowing through the gas flow pipe is lower than a fluid flowing through the gas flow pipe at the flow path branching portion.

4. A sampling air supplying method for a smoke detector, the smoke detector including:

a smoke detection portion having an inflow port and an outflow port;

a sampling pipe laid in a monitor space;

a gas flow pipe which is connected to the sampling pipe and which houses a fan therein;

a flow path branching portion provided to the gas flow pipe on a secondary side of the fan and connected to the inflow port of the smoke detection portion; and a flow path merging portion which is provided on the secondary side of the fan and in the vicinity thereof and connected to an outflow port of the smoke detection portion, and at which a pressure of a fluid flowing through the gas flow pipe is lower than a fluid flowing through the gas flow pipe at the flow path branching portion, the sampling air supplying method comprising introducing a part of the fluid from the flow path branching portion to the smoke detection portion owing to a pressure difference in the fluid on the secondary side of the fan.

* * * * *